US005925199A

United States Patent [19]

Shiina et al.

[11] Patent Number: 5,925,199

[45] Date of Patent: Jul. 20, 1999

[54] PROCESS FOR PRODUCING A THIXOCAST SEMI-MOLTEN MATERIAL

[75] Inventors: Haruo Shiina; Nobuhiro Saito; Takeyoshi Nakamura, all of Saitama, Japan

[73] Assignee: Honda Giken Kogyo Kabushiki Kaisha, Tokyo, Japan

[21] Appl. No.: 08/755,296

[22] Filed: Nov. 22, 1996

Related U.S. Application Data

[62] Division of application No. 08/543,193, Oct. 13, 1995.

[30] Foreign Application Priority Data

Oct. 14, 1994 [JP] Japan ..... 6-275604

[51] Int. Cl.[6] ..... B22D 27/02; B22D 27/04; C22F 1/00

[52] U.S. Cl. ..... 148/538; 148/549; 420/546; 420/548; 420/550; 420/590; 164/471; 164/493; 164/900

[58] Field of Search ..... 164/900, 493, 164/471; 420/590, 546, 548, 550, 534; 148/538, 549

[56] References Cited

U.S. PATENT DOCUMENTS

| | | | |
|---|---|---|---|
| 3,936,298 | 2/1976 | Mehrabian et al. . | |
| 3,948,650 | 4/1976 | Flemings et al. . | |
| 4,162,700 | 7/1979 | Kahn | 164/338 |
| 4,577,676 | 3/1986 | Watson | 164/468 |
| 4,580,616 | 4/1986 | Watts | 164/457 |
| 4,687,042 | 8/1987 | Young | 164/80 |
| 4,712,413 | 12/1987 | Koch | 164/900 |
| 4,809,764 | 3/1989 | Prasad | 164/122 |
| 4,922,995 | 5/1990 | Movchan et al. | 164/483 |
| 4,964,455 | 10/1990 | Meyer | 164/468 |
| 5,009,844 | 4/1991 | Laxmanan | 420/348 |
| 5,133,811 | 7/1992 | Kirkwood et al. | 148/552 |
| 5,219,018 | 6/1993 | Meyer | 164/468 |
| 5,236,033 | 8/1993 | Goy et al. | 164/123 |
| 5,394,931 | 3/1995 | Shiina et al. | 164/113 |
| 5,571,346 | 11/1996 | Bergsma | 164/900 |
| 5,579,825 | 12/1996 | Shibata et al. | 164/900 |

FOREIGN PATENT DOCUMENTS

| | | | |
|---|---|---|---|
| 530968 | 3/1993 | European Pat. Off. . | |
| 2-51703 | 11/1990 | Japan . | |
| 6297096 | 10/1994 | Japan | 164/900 |
| 6-328225 | 11/1994 | Japan . | |
| 8-157994 | 6/1996 | Japan . | |
| 1406026 | 1/1975 | United Kingdom . | |
| 9106386 | 5/1991 | WIPO . | |

*Primary Examiner*—Margery Phipps
*Attorney, Agent, or Firm*—Lyon & Lyon LLP

[57] ABSTRACT

Solid and liquid phases coexist in a semi-molten casting material. A plurality of composite-solid phases having liquid and solid phase regions and a plurality of single-solid phases exist as the solid phases in a mixed state in an outer layer portion of the semi-molten casting material. If the sectional area of the solid phase region is represented by A, and the sectional area of the solid phase region is represented by B in one of the composite-solid phases, the liquid phase enclosure rate P of the composite-solid phase is defined as being represented by $P=\{B/(A+B)\}\times 100$ (%). The liquid phase enclosure rate P of the single-solid phase is equal to 0 (%). When two groups are selected from a class of the solid phases, for example, by first and second straight lines so as to include a plurality of the solid phases, average values $M_1$ and $M_2$ of liquid phase enclosure rates of, for example, six solid phases in each of the first and second groups are represented by $M_1=(P_1+P_2 - - - +P_5+P_6)/6$ and $M_2=(P_7+P_8 - - - +P_{11}+P_{12})/6$, and an average value $M_M$ of the average values $M_1$ and $M_2$ is set in a range of $M_M \geqq 20\%$. This inhibits the flow-out of the liquid phases from the outer layer portion in the thixocast semi-molten casting material.

7 Claims, 18 Drawing Sheets

Main body portion

Outer layer portion

Main body portion

Outer layer portion

Main body portion

100μm

Outer layer portion

100μm

Main body portion

Outer layer portion

Main body portion

100μm

Outer layer portion

100μm

PROCESS FOR PRODUCING A THIXOCAST SEMI-MOLTEN MATERIAL

This is a Divisional Application of Ser. No. 08/543,193, filed Oct. 13, 1995.

BACKGROUND OF THE INVENTION

1. Field of the Invention

The present invention relates to a thixocasting semi-molten casting material, and a process for producing the same.

2. Description of the Prior Art

In carrying out a thixocasting process, a procedure is employed which involves subjecting a casting material to a heating treatment to produce a semi-molten casting material having a solid phase (a substantially solid phase and this term will also be applied hereinafter) and a liquid phase coexisting therein, charging the semi-molten casting material into a cavity in a casting mold under a pressure, and solidifying the semi-molten casting material under the pressure.

In the heating treatment, the solid phase content in the semi-molten casting material is set such that the thixocasting process is smoothly conducted. Under such a solid phase content, the flow resistance to the semi-molten casting material is reduced and hence, the following disadvantage is liable to arise: a portion of the semi-molten casting material flows out, or the semi-molten casting material is deformed.

An approach employed in the prior art is to fit the casting material with a ring prior to the heating treatment to prevent the flow-out and the deformation by the ring (for example, see U.S. Pat. No. 4,712,413).

However, the prior art approach is accompanied by a problem of the need for operations including the fitting of the casting material with the ring, the detachment of the ring from the casting material and the removal of a solidified metal portion deposited to the ring, resulting in a complicated casting procedure.

From the metallographic and economic viewpoints, the casting material has been produced generally by utilizing an agitated continuous casting process, but in the process for producing the casting material, it is not avoided that an outer layer portion having dendrites exists around an outer periphery of a main body portion of the casting material. The dendrites cause the pressure for charging the semi-molten casting material into the cavity to rise to impede the complete charging of the semi-molten casting material into the cavity, and hence, the dendrites are useless in the casting material.

Therefore, following approaches have been conventionally employed: an approach to remove the dendrites by a dendrite trap mounted in a casting mold (see Japanese Patent Publication No. 51703/90, and an approach to subject the casting material to a cutting to remove the outer layer portion.

However, the former approach for removing the dendrites by the dendrite trap mounted in the casting mold causes the structure of the casting mold to be complicated, and brings about an increase in cost. The latter approach to cut off the outer layer portion brings about an increases in process steps and a deterioration of productivity.

SUMMARY OF THE INVENTION

It is an object of the present invention to provide a semi-molten casting material of the above-described type, which has a good shape retention and which is capable of being prevented from flowing out and from being deformed by specifying the structure of the outer layer portion in the semi-molten state.

To achieve the above object, according to the present invention, there is provided a thixocast semi-molten casting material having solid and liquid phases coexisting therein, wherein the material comprises a plurality of composite-solid phases each having a liquid phase region and a solid phase region enclosing the liquid phase region, and a plurality of single-solid phases having no liquid phase region, the composite-solid phases and the single-solid phases being mixed as the solid phases in an outer layer portion of the semi-molten casting material, and wherein if a liquid phase enclosure rate P of the composite-solid phases is defined as being represented by $P=\{B/(A+B)\}\times 100$ (%), where A is a sectional area of the solid phase region, and B is a sectional area of the liquid phase region, and the liquid phase enclosure rate P of the single-solid phase is defined as being represented by P=0 (%), and if an N number of groups are selected from a class of the solid phases in the outer layer portion so as to include plural ones of the solid phases, average values $M_1$ to $M_N$ of liquid phase enclosure rates $P_1$, $P_2$, - - - $P_{n-1}$ and $P_n$ of an n number of solid phases in first to N-th groups are represented by $M_1=(P_1+P_2 - - - +P_{n-1} P_n)/n$ to $M_N=(P_{N1}+P_{N2} - - - +P_{Nn-}+P_{Nn})/n$, and an average value $M_M(=(M_1+M_2 - - - +M_{N-1}+M_N)/N)$ of the average values $M_1$ to $M_N$ is set in a range of $M_M \geqq 20\%$.

In addition, according to the present invention, there is provided a thixocasting semi-molten casting material having solid and liquid phases coexisting therein, wherein the solid phases existing in an outer layer portion of the casting material are a plurality of composite-solid phases each having a liquid phase region and a solid phase region enclosing the liquid phase region, and wherein if a liquid phase enclosure rate P of the composite-solid phases is defined as being represented by $P=\{B/(A+B)\}\times 100$ (%) , where A is a sectional area of the solid phase region, and B is a sectional area of the liquid phase region, and if an N number of groups are selected from a class of the composite-solid phases in the outer layer portion so as to include plural ones of the composite-solid phases, average values $M_1$ to $M_N$ of liquid phase enclosure rates $P_1$, $P_2$, - - - $P_{n-1}$ and $P_n$ of an n number of the composite-solid phases in first to N-th groups are represented by $M_1=(P_1+P_2 - - - +P_{n-1}+P_n)/n$ to $M_N=(P_1+P_2 - - - +P_{n-1}+P_n)/n$, and an average value $M_M(=(M_1+M_2 - - - +M_{N-1}+M_N)/N)$ of the average values $M_1$ to $M_N$ is set in a range of $M_M \geqq 20\%$.

If the composite-solid phases and the single-solid phases exist in the outer layer portion, or if only the composite-solid phases exist in the outer layer portion, the amount of the liquid phase around the solid phase is decreased in accordance with the amount of liquid phase enclosed in the composite-solid phase.

Therefore, if the average value $M_M$ relating to the liquid phase enclosure rate P in the outer layer portion is set in the range of $M_M \geqq 20\%$, the apparent solid phase content in the outer layer portion is increased more than an actual solid phase content in accordance with the average value $M_M$. Thus, it is possible to enhance the shape retention of the semi-molten casting material to inhibit the flow-out and the deformation.

However, if the average value $M_M$ is lower than 20%, the flow-out of the liquid phase occurs, resulting in a sudden increase in weight loss.

In addition, it is another object of the present invention to provide a producing process of the above-described type, wherein the dendrites in the outer layer portion can be transformed into spherical solid phases having a good castability at the stage in which the casting material is heated into a semi-molten state.

To achieve the above object, according to the present invention, there is provided a process for producing a thixocast semi-molten casting material, comprising the steps of subjecting a thixocast material including an outer layer portion having dendrites around an outer periphery of a main body portion to a heating treatment to thereby produce a semi-molten casting material having solid and liquid phases coexisting therein, the dendrites being transformed into spherical solid phases by rising the temperature of the outer layer portion preferentially to the main body portion to thereby bring the outer layer portion into a semi-molten state.

When the outer layer portion in the casting material is brought into the semi-molten state by the heating, the dendrites existing in the outer layer portion can be transformed into the spherical solid phases. In this case, the semi-melting of the main body portion is delayed behind the outer layer portion and therefore, the prolongation of the heating time for the main body portion can be avoided to prevent the coalescence or bulking of the metallographic structure of the main body portion.

Thus, it is possible to completely the semi-molten casting material smoothly into the cavity under a low charging pressure to produce a sound cast product. In addition, the disadvantages of the complication of the structure of the casting mold and the increase in number of steps cannot be arisen as in the prior art.

The above and other objects, features and advantages of the invention will become apparent from the following description of preferred embodiments taken in conjunction with the accompanying drawings.

DESCRIPTION OF THE PREFERRED EMBODIMENTS

I. Thixocast Semi-Molten Casting Material

Figure 1:
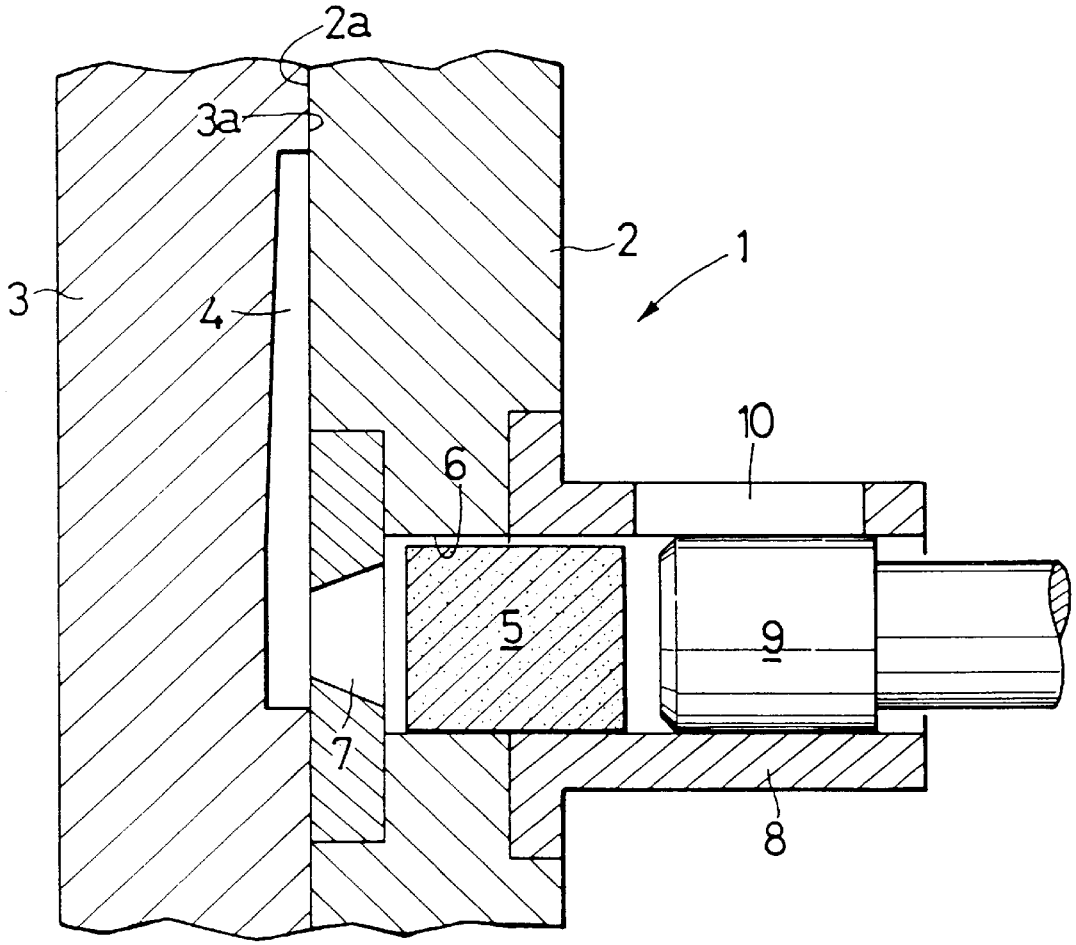
FIG. 1 is a vertical sectional view of a first example of a pressure casting apparatus.

FIG. 1 shows a first example of a pressure casting apparatus 1 used for producing a cast product in a thixocasting process. The pressure casting apparatus 1 includes a stationary die 2 and a movable die 3, which have vertical mating surfaces 2*a* and 3*a*, respectively. A casting cavity 4 is defined between the mating surfaces 2*a* and 3*a*. A chamber 6, into which a semi-molten casting material 5 is placed, is defined in the stationary die 2 and communicates with a lower portion of the cavity 4 through a gate 7. A sleeve 8 is horizontally mounted to the stationary die 2 to communicate with the chamber 6, and a pressing plunger 9 is slidably received in the sleeve 8 for sliding movement into and out of the chamber 6. The sleeve 8 has a material inlet 10 in an upper portion of its peripheral wall.

In a casting operation, a casting material 5 is cut away from a long continuous cast product of a high quality produced in an agitated continuous casting process and then, the casting material 5 is placed into a heating coil in an induction heating apparatus and heated therein to produce a casting material 5 in a semi-molten state having solid and liquid phases coexisting in the material. In this case, the solid phase content is set in a range of 50% (inclusive) to 60% (inclusive).

Thereafter, the semi-molten casting material 5 is placed into the chamber 6, and the plunger 9 is operated to cause the semi-molten casting material 5 to be charged through the gate 7 into the cavity 4, while being pressed. Then, a pressing force is applied to the semi-molten casting material 5 filled in the cavity 4 by retaining the pressing plunger 9 at a stroke end, thereby solidifying the semi-molten casting material 5 under such pressing force applied to provide a cast product.

Table 1 shows the composition of a hypoeutectic aluminum alloy material as a casting material.

TABLE 1

| Al alloy | Chemical constituent (% by weight) | | | | |
|---|---|---|---|---|---|
| material | Si | Mg | Fe | Ti | Balance |
| | 6.6 | 0.6 | 0.13 | 0.01 | Al |

Three alloy materials I, II and III having the composition as shown in Table 1 and having a diameter of 76 mm and a length of 85 mm were prepared.

Figure 2:
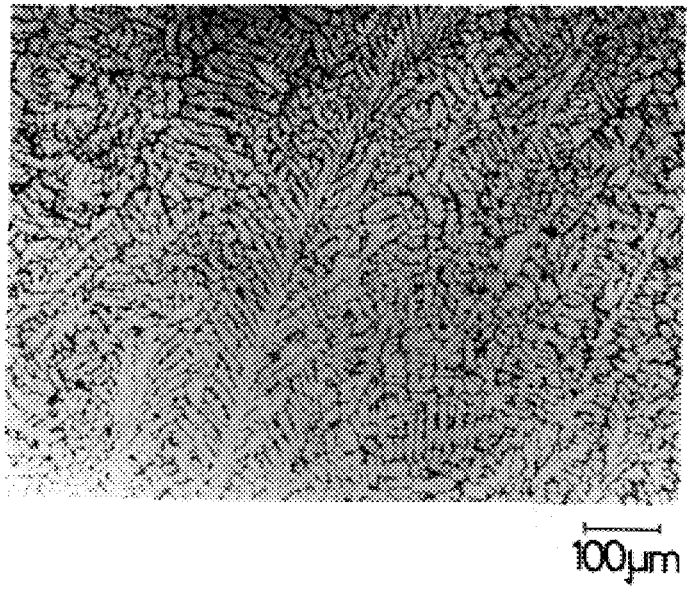
FIG. 2 is a photomicrograph showing the metallographic structure of an outer layer portion in a first example of an aluminum alloy material.

FIG. 2 is a photomicrograph showing the metallographic structure of an outer layer portion of the aluminum alloy material I. It can be seen from FIG. 2 that the outer layer portion is formed of dendrites grown bulkily. Each of the dendrites is of α-Al, and the portions filling areas between the dendrites are of eutectic Al—Si.

Figure 3:
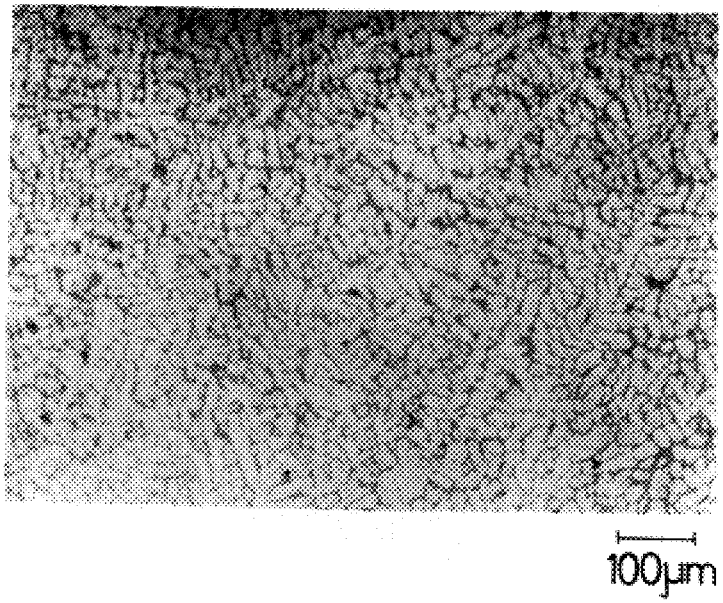
FIG. 3 is a photomicrograph showing the metallographic structure of an outer layer portion in a second example of an aluminum alloy material.

FIG. 3 is photomicrograph showing the metallographic structure of an outer layer portion of the aluminum alloy material II. It can be seen from FIG. 2 that the outer layer portion is formed of dendrites, but its dendrite arm spacing is larger than that in the aluminum alloy material I. Likewise, each of the dendrites is of α-Al, and the portions filling areas between the dendrites are of eutectic Al—Si.

Figure 4:
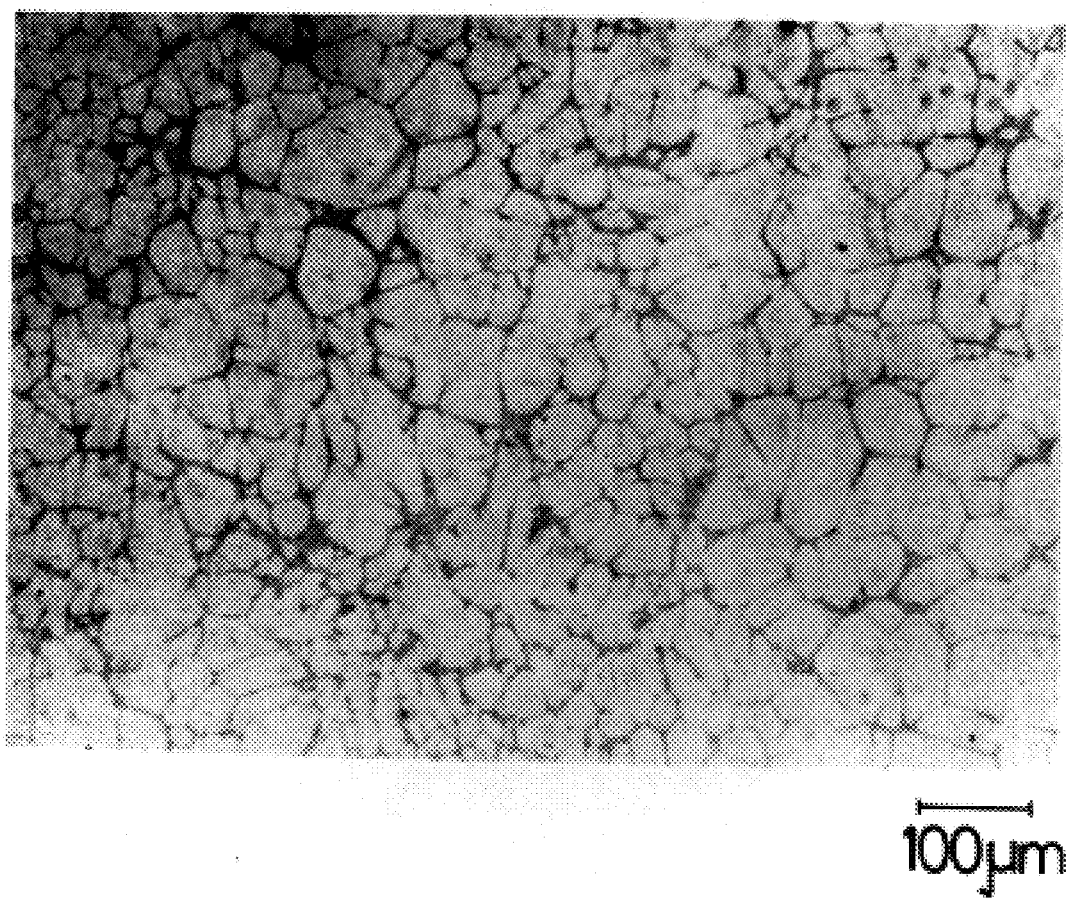
FIG. 4 is a photomicrograph showing the metallographic structure of an outer layer portion in a third example of an aluminum alloy material.

FIG. 4 is a photomicrograph showing the metallographic structure of an outer layer portion of the aluminum alloy material III. It can be seen from FIG. 4 that the outer layer portion has a spherical structure. Each of spherical portions is of α-Al, and the portions filling the areas between spherical portions are likewise of eutectic Al—Si.

Then, the aluminum alloy material I was placed into the heating coil in the induction heating apparatus and then heated under conditions of a frequency of 1 kHz and an energizing time of 7 minutes (output 90% for first 3 minutes, output 52% for next 1 minute and output 37% for last 3 minutes), until the solid phase reached 60%, thereby producing a semi-molten aluminum alloy material I. Thereafter, the metallographic structure of the semi-molten aluminum alloy material I was fixed by a quenching process.

Figure 5A:
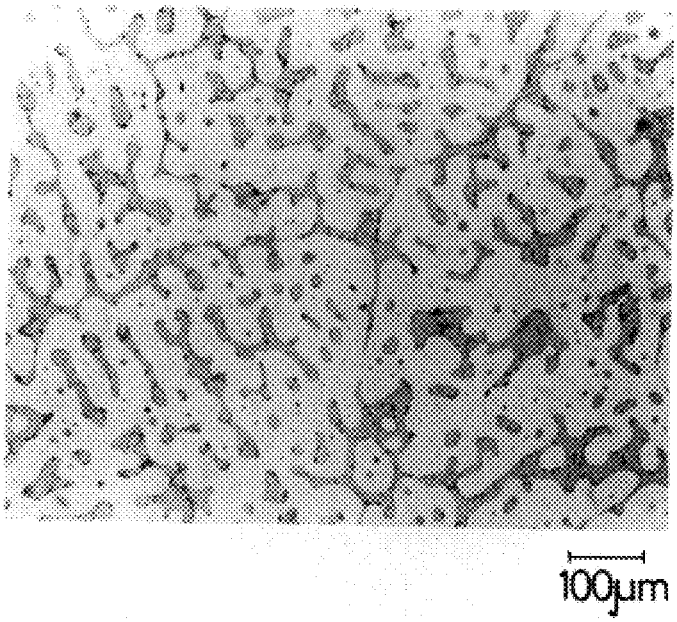
FIG. 5A is a photomicrograph showing the metallographic structure of an outer layer portion in a first example of a semi-molten aluminum alloy material.
Figure 5B:
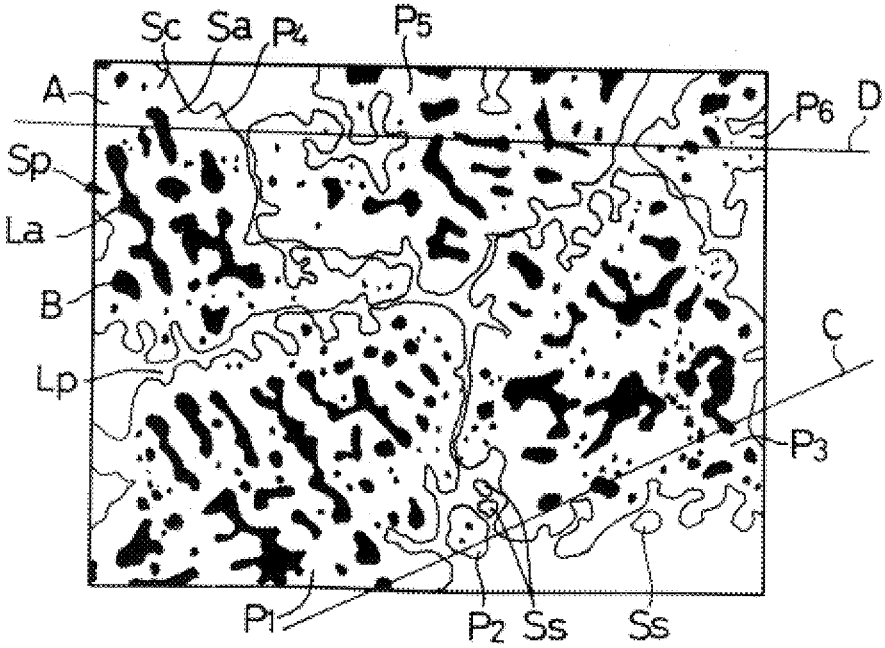
FIG. 5B is a tracing of an essential portion shown in FIG. 5A.

FIG. 5A is a photomicrograph showing the metallographic structure of an outer layer portion of the semi-molten aluminum alloy material I, and FIG. 5B is a tracing of an essential portion shown in FIG. 5A.

In FIGS. 5A and 5B, each of the massive portions is a solid phase Sp, and the portions filling the areas between the solid phases Sp correspond to a liquid phase Lp. The solid phases Sp are a mixture of a plurality of composite-solid phases Sc each having a liquid phase region La and a solid phase region Sa enclosing the liquid phase region La, with a plurality of single-solid phases Ss having no liquid phase region La.

The solid phase regions Sa of the composite-solid phase Sc and the single solid phases Ss comprise α-Al, and the liquid phase regions La of the composite-solid phase Sc and the liquid phases Lp comprise eutectic Al—Si.

The liquid phase enclosure rate P of one of the composite-solid phases Sc is defined as being represented by $P=\{B/(A+B)\}\times 100$ (%), and the liquid phase enclosure rate P of the single-solid phase Ss is defined as being represented by P=0 (%) , wherein A is a sectional area of the solid phase region Sa, and B is a sectional area of the liquid phase region La (a sum of sectional areas of all the liquid phase regions La enclosed by the solid phase region Sa). When an N number of groups are selected from a class of solid phases Sp (including the composite-solid phases Sc and the single-solid phases Ss) in the outer layer so as to include a plurality of the solid phases Sp, the average values $M_N$ to $M_n$ of liquid phase enclosure rates $P_1, P_2, - - - P_{n-1}$ and $P_n$ of an n number of solid phases Sp in the first to N-th groups are represented by $M_1=(P_1+P_2 - - - +P_{n-1}+P_n)/n$, - - - and $M_N=(P_{N1}+P_{N2} - - - +P_{Nn1}+P_{Nn})/n$, and the average value $M_M$ of these average values $M_1$ to $M_N(=(M_1+M_2 - - - +M_{N-1}+M_N)/N$ is set in a range of $M_M \geqq 20\%$.

In the outer layer of the semi-molten aluminum alloy material I, the average value $M_M$ relating to the liquid phase enclosure rate P was determined in a manner which now will be described. (i) As shown in FIG. 5B, two or more (two in the illustrated embodiment) first and second straight lines C and D are drawn on the photomicrograph, and two (N) groups were selected from a resulting class of solid phases Sp so as to include plural ones of these solid phases Sp. (ii) Liquid phase enclosure rates $P_1$, $P_2$ and $P_3$ of the three (n number of) composite-solid phases Sc in the first group crossed by the first straight line C were determined, and a first average value $M_1(=P_1+P_2+P_3)/3)$ was calculated. In this case, $M_1$ was equal to 19%. (iii) Liquid phase enclosure rates $P_4$, $P_5$ and $P_6$ of the three (n number of) composite-solid phases Sc in the second group crossed by the second straight line C were determined, and a second average value $M_2(=P_4+P_5+P_6)/3)$ was calculated. In this case, $M_2$ was equal to 21%. (iv) An average value of the first and second average values $M_1$ and $M_2$, i.e., $M_M(=M_1+M_2)/2)$ was calculated as the average value $M_M$.

Thus, it was made clear that the average value $M_M$ relating to the liquid phase enclosure rates P in the outer layer portion of the semi-molten alloy material I was equal to 20% ($M_M$=(19% +21%)/2=20%).

Figure 6A:
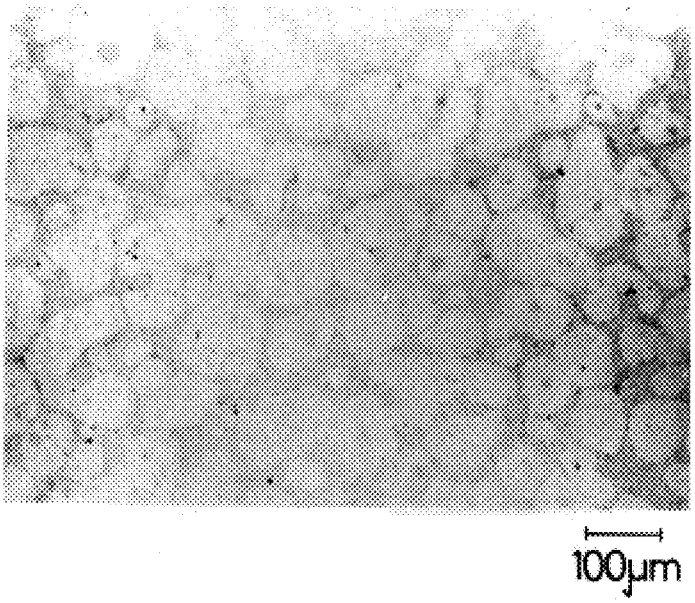
FIG. 6A is a photomicrograph showing the metallographic structure of an outer layer portion in a second example of a semi-molten aluminum alloy material.
Figure 6B:
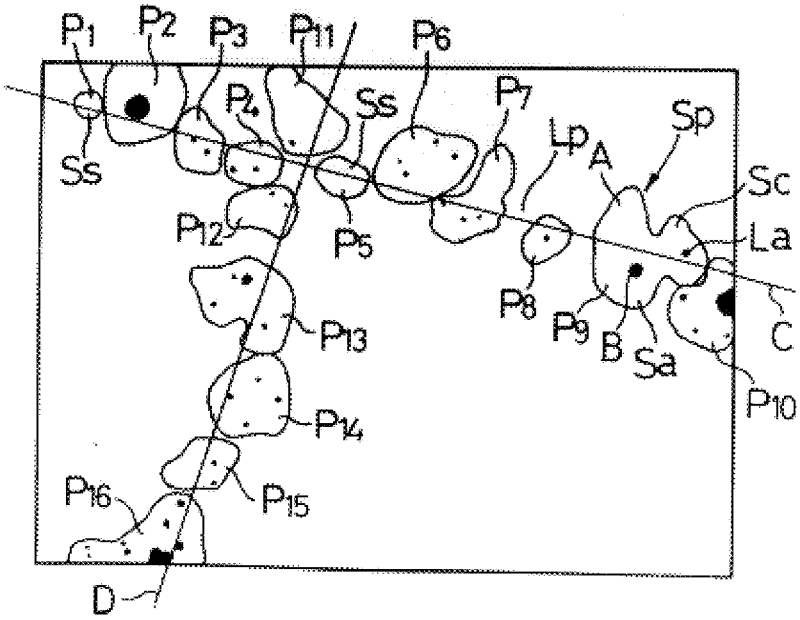
FIG. 6B is a tracing of an essential portion shown in FIG. 6A.

FIG. 6A is a photomicrograph showing the metallographic structure of an outer layer portion of the semi-molten aluminum alloy material II, and FIG. 6B is a tracing of an essential portion shown in FIG. 6A.

In this case, a first average value $M_1(=(P_1+P_2 - - - P_9+P_{10})/10)$ (with a proviso that $P_1$ and $P_5=0$) was equal to 1.7%, and a second average value $M_2(=(P_{11}+P_{12} - - - P_{15}+P_{16})/6)$ was equal to 1.8%. Thus, it was made clear that the average value $M_M$ relating to the liquid phase enclosure rates P in the outer layer portion of the semi-molten alloy material II was equal to about 1.8% ($M_M=(1.7\%+1.8\%)/2=1.8\%$).

Figure 7A:
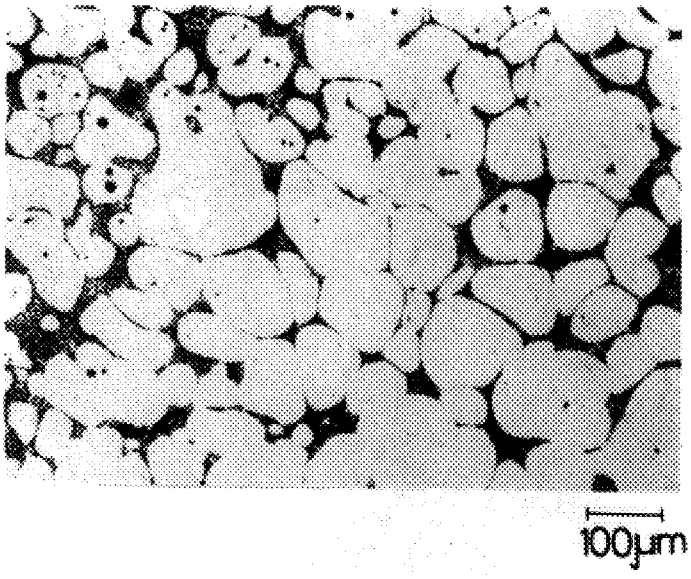
FIG. 7A is a photomicrograph showing the metallographic structure of an outer layer portion in a third example of a semi-molten aluminum alloy material.
Figure 7B:
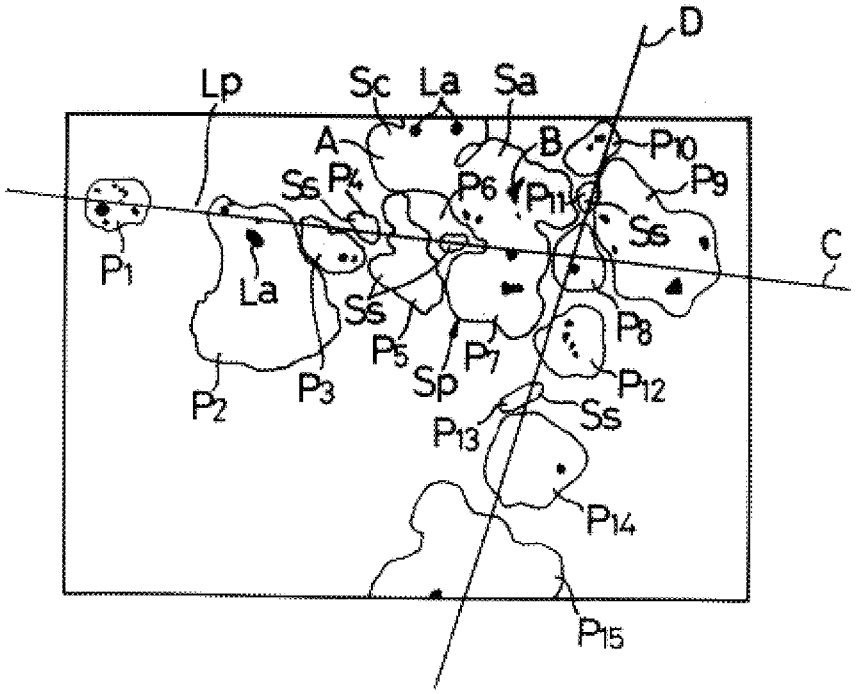
FIG. 7B is a tracing of an essential portion shown in FIG. 7A.

FIG. 7A is a photomicrograph showing the metallographic structure of an outer layer portion of the semi-molten aluminum alloy material III, and FIG. 7B is a tracing of an essential portion shown in FIG. 7A.

In this case, a first average value $M_1(=(P_1+P_2 - - - P_8+P_9)/9)$ (with a proviso that $P_4$, $P_5$ and $P_6=0$) was equal to 0.8%, and a second average value $M_2(=(P_8+P_{10} - - - P_{14}+P_{15})/7)$ (with a proviso that $P_{11}$ and $P_{13}=0$) was equal to 0.2%. Thus, it was made clear that the average value $M_M$ relating to the liquid phase enclosure rates P in the outer layer portion of the semi-molten alloy material III was equal to 0.5% ($M_M=(0.8\% +0.2\%)/2=0.5\%$).

Table 2 shows the relationship between the average value $M_M$ relating to the liquid phase enclosure rate P and the weight loss in the outer layer portions of the semi-molten alloy materials I, II and III and other semi-molten alloy materials IV, V and VI. In the outer layer portion in the semi-molten alloy material IV, only single-solid phases Ss exist and no composite-solid phase Sc exists.

TABLE 2

| Semi-molten Al alloy material | Average value $M_M$ (%) relating to liquid enclosure rates P | Weight loss (% by weight) |
|---|---|---|
| I | 20 | 10 |
| II | 1.8 | 19 |
| III | 0.5 | 19.5 |
| IV | 0 | 22 |
| V | 25 | 9 |
| VI | 30 | 8 |

Figure 8:
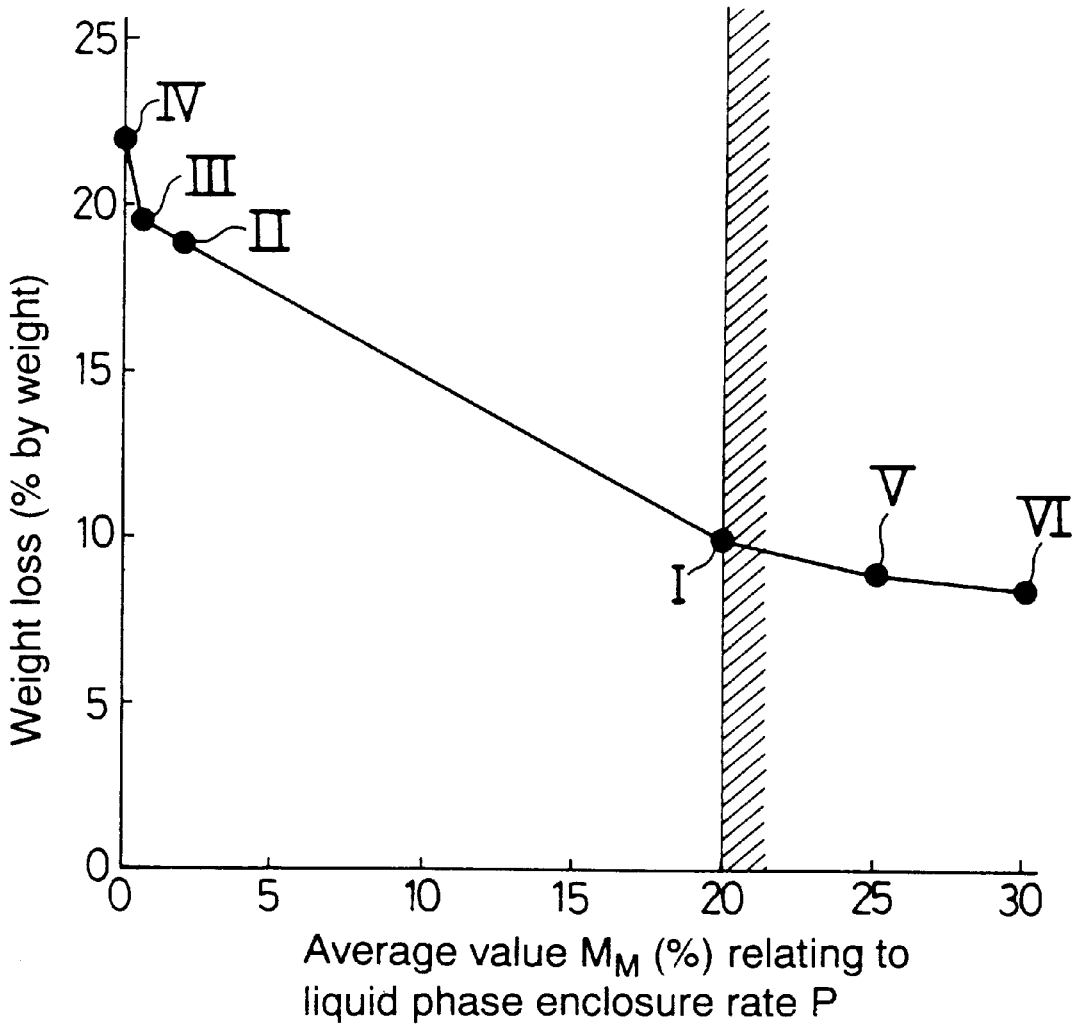
FIG. 8 is a graph illustrating the relationship between the average value $M_M$ relating to the liquid phase enclosure rate P and the weight loss.

FIG. 8 is a graph illustrating the relationship between the average value $M_M$ (%) relating to liquid phase enclosure rates P and the weight loss based on Table 2. As apparent is from FIG. 8, the weight loss can be reduced to 10% by weight or less by setting the average value $M_M$ in a range of $M_M \geqq 20\%$.

The present invention embraces a thixocast semi-molten casting material in which the solid phases Sp existing in the outer layer portion are a plurality of composite-solid phases Sc each having a liquid phase region La and a solid phase region Sa enclosing the liquid phase region La. In this case, the liquid phase enclosure rate P of one of the composite-solid phases Sc is defined as being represented by $P=\{B/(A+B)\}\times 100$ (%), wherein A is a sectional area of the solid phase region Sa, and B is a sectional area of the liquid phase region La. When an N number of groups are selected from a class of composite-solid phases Sc in the outer layer portion so as to include plural ones of the composite-solid phases Sc, average values $M_1$ to $M_N$ of liquid phase enclosure rates $P_1$, $P_2$, - - - $P_{n-1}$ and $P_n$ of an n number of the composite-solid phases Sc in the first to N-th groups are represented by $M_1=(P_1+P_2 - - - +P_{n-1}+P_n)/n$, - - - and $M_N=(P_{N1}+P_{N2} - - - +P_{Nn-1}+P_{Nn})/n$, and the average value $M_M$ of these average values $M_1$ to $M_N(=(M_1+ M_2 - - - + M_{N-1}+M_N)/N$ is set in a range of $M_M \geqq 20\%$.

II. Production of Thixocast Semi-Molten Casting Material

Figure 9:
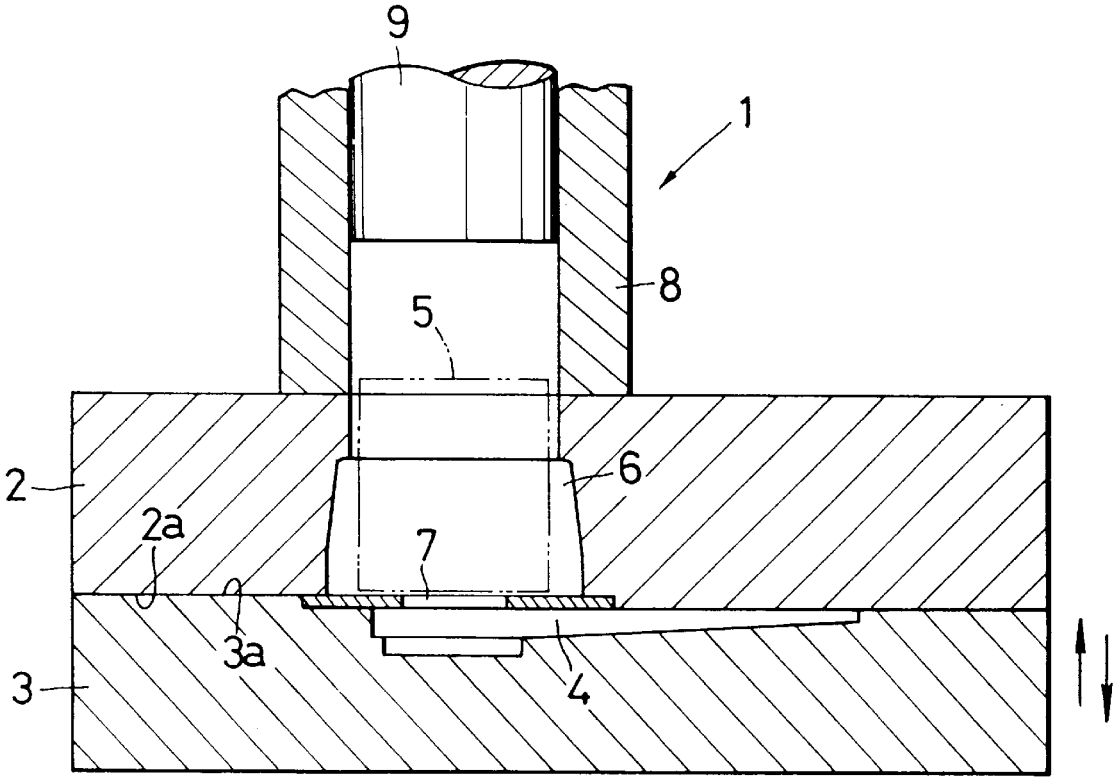
FIG. 9 is a vertical sectional view of a second example of a pressure casting apparatus.

FIG. 9 shows a pressure casting apparatus 1 used in the production of a cast product in a thixocasting process. The pressure casting apparatus 1 includes a stationary die 2 and a movable die 3, which have horizontal mating surfaces 2*a* and 3*a*, respectively. A casting cavity 4 is defined between the mating surfaces 2*a* and 3*a*. A chamber 6, into which a semi-molten casting material 5 is placed, is defined in the stationary die 2 and communicates with the cavity 4 through a gate 7. A sleeve 8 is mounted to extend upwardly from on the stationary die 2 to communicate with the chamber 6, and a pressing plunger 9 is slidably received in the sleeve 8 for sliding movement into and out of the chamber 6.

(A) Relationship Between Casting Material and Heating Means

EXAMPLE 1A

Using a molten metal having a hypoeutectic aluminum alloy composition shown in Table 3, a rounded rod-like cast product having a diameter of 76 mm was produced in the agitated continuous casting process.

TABLE 3

| | Chemical constituent (% by weight) | | | | | |
|---|---|---|---|---|---|---|
| Al alloy | Si | Cu | Mg | Fe | Ti | Balance |
| | 7.0 | <0.2 | 0.45 | <0.2 | <0.2 | Al |

Figure 10A:
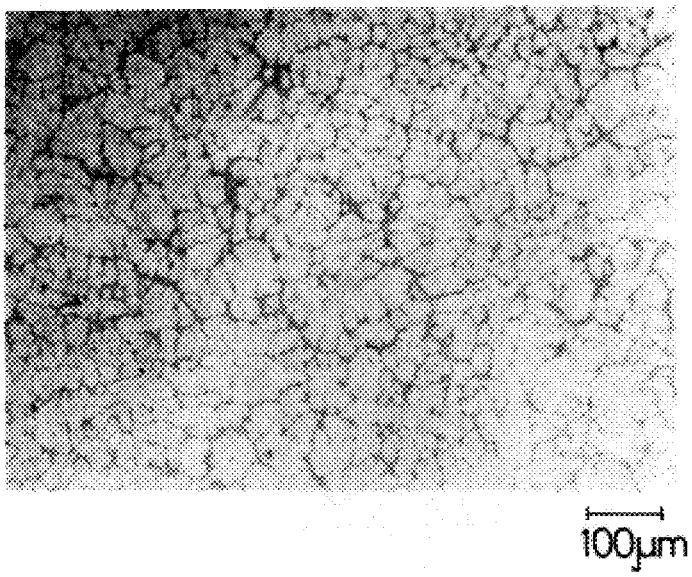
FIG. 10A is a photomicrograph showing the metallographic structure of a main body portion in a fourth example of an aluminum alloy material.
Figure 10B:
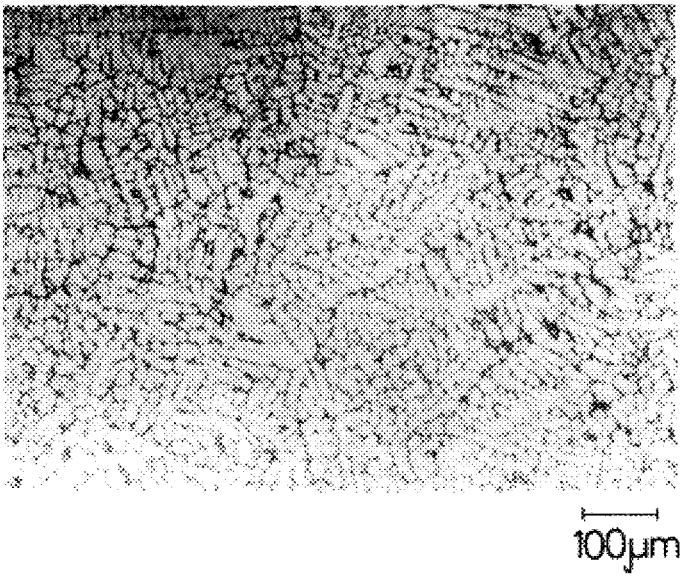
FIG. 10B is a photomicrograph showing the metallographic structure of an outer layer portion in the fourth example of the aluminum alloy material.

An aluminum alloy material as a casting material having a length of 100 mm was cut away from the rounded rod-like cast product and examined for its metallographic structure to provide the results shown in FIGS. 10A and 10B.

FIG. 10A is a photomicrograph showing the metallographic structure of a main body portion, and FIG. 10B is a photomicrograph showing the metallographic structure of an outer layer portion existing around an outer periphery of the main body portion.

As is apparent from FIG. 10A, the main body portion has a large number of spherical crystals of α-Al, and eutectic crystals filling the areas between the spherical crystals of α-Al. As is apparent from FIG. 10B, the outer layer portion has a large number of dendrites, and eutectic Al—Si filling areas between the dendrites. The dendrites are formed of α-Al.

In this case, the area rate a of α-Al in the outer layer portion is equal to 86%, and the area rate b of α-Al in the main body portion is equal to 75%. These area rates a and b were measured using an image analysis system and the same system will be used hereinafter for such measurements.

The aluminum alloy material, as an example 1, was placed into an induction heating furnace and then subjected to an induction heating under conditions of a frequency f of 1 kHz (constant) and an energizing time of 7 minutes (output 90% for first 3 minutes, output 50% for next 1 minute and output 37% for last 3 minutes).

In this case, the electric resistance value of the outer layer portion was lower than that of the main body portion due to the fact that the area rate a of α-Al in the outer layer portion was higher than the area rate b of α-Al in the main body portion and the α-Al had a good conductivity. Therefore, a skin effect remarkably appeared in the outer layer portion, thereby causing the outer layer portion to rise in temperature preferentially to the main body portion to become a semi-molten state having solid and liquid phases coexisting therein. A subsequent induction heating caused the main body portion to rise in temperature to likewise become a semi-molten state having solid and liquid phases coexisting therein.

Figure 11A:
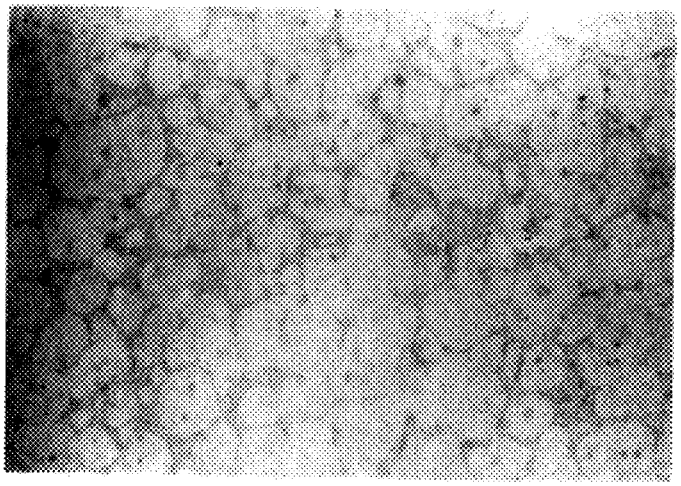
FIG. 11A is a photomicrograph showing the metallographic structure of a main body portion in the fourth example of a semi-molten aluminum alloy material.
Figure 11B:
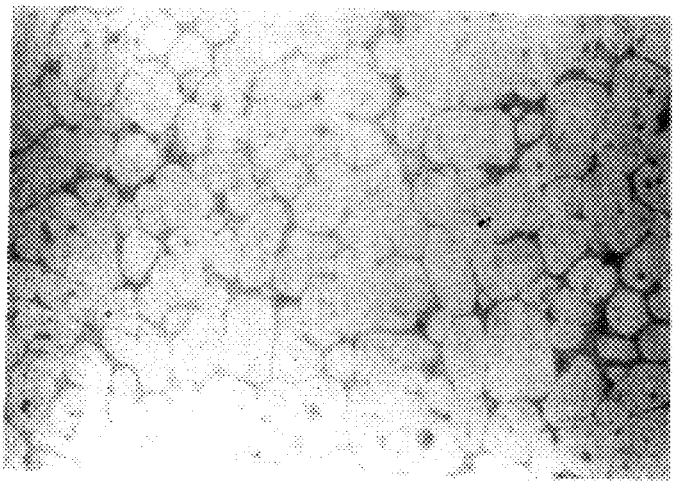
FIG. 11B is a photomicrograph showing the metallographic structure as an outer layer portion in the fourth example of the semi-molten aluminum alloy material.

In this manner, the aluminum alloy material was heated up to 575° C. which is a castable temperature and then, the metallographic structure in the semi-molten state was fixed by a quenching process and examined to provide a result shown in FIGS. 11A and 11B.

FIG. 11A is a photomicrograph showing the metallographic structure of a main body portion, and FIG. 11B is a photomicrograph showing the metallographic structure of an outer layer portion.

As is apparent from FIG. 11B, it can be seen that the dendrites in the outer layer portion were transformed into spherical solid phases by the semi-melting. In this case, an average diameter D of the spherical solid phases of α-Al is equal to 150 μm. Here, the term "average diameter" is defined as an average value of lengths of longest portions of all the spherical solid phases in the photomicrograph. This also applies to the average diameter D which will be described hereinafter.

As is apparent from FIG. 11A, the main body portion also has a spherical structure and in this case, an average diameter D of the spherical solid phases of α-Al is equal to 120 μm. The reason why the fines metallographic structure is obtained in the main body portion in this manner is that the semi-melting of the main body portion is delayed behind that of the outer layer portion and hence, the prolongation of the heating time for the main body portion is avoided to prevent the bulking or coalescence of the metallographic structure.

Then, the die temperature was set at 250° C. in the pressure casting apparatus 1 shown in FIG. 9, and the semi-molten alloy material I (designated by reference character 5) obtained after the heating was placed into the chamber 6. The pressing plunger 9 was operated to charge the semi-molten alloy material I into the cavity 4. In this case, the pressure for charging the semi-molten alloy material I (the pressure applied to the pressing plunger 9 and this will be the same hereinafter) was of 8 MPa. Then, a pressing force was applied to the semi-molten alloy material I filled in the cavity 4 by retaining the pressing plunger 9 at a stroke end, thereby solidifying the semi-molten alloy material I under such pressure to provide an aluminum alloy cast product.

Subsequently, examples of aluminum alloy materials II, III, IV, V and VI were produced which had the composition shown in Table 3, different area rates a and b of crystals α-Al in the outer layer portion and the main body portion, and the same size as that described above.

Then, each of the aluminum alloy materials II, III, IV, V and VI was placed into the induction heating furnace and heated under the same conditions as those described above. Thereafter, the metallographic structure in the semi-molten state was fixed at a castable temperature of 575° C. in the same manner and then measured.

Using the aluminum alloy materials II, III, IV, V and VI after being heated and using the pressure casting apparatus shown in FIG. 9, various aluminum alloy cast products were produced by the same casting operation as that described above.

Table 4 shows the area rates a and b of α-Al in the outer layer portion and the main body portion of each of the aluminum alloy materials I, II, III, IV, V and VI, the difference a−b between the area rates a and b, the form of the solid phase in the semi-molten outer layer portion, and the charging pressure during the casting.

TABLE 4

| Al alloy material | Area rate of α-Al (%) Outer layer portion a | Main body portion b | Difference a − b | Form of solid phase in semi-molten outer layer portion | Charging pressure during casting (MPa) |
|---|---|---|---|---|---|
| I | 86 | 75 | 11 | spherical | 8 |
| II | 80 | 75 | 5 | spherical | 8.5 |
| III | 90 | 75 | 15 | spherical | 9 |
| IV | 88 | 75 | 13 | spherical | 8 |
| V | 78 | 75 | 3 | dendrite, spherical in part | 10 |
| VI | 92 | 75 | 17 | massive | 15 |

Figure 12A:
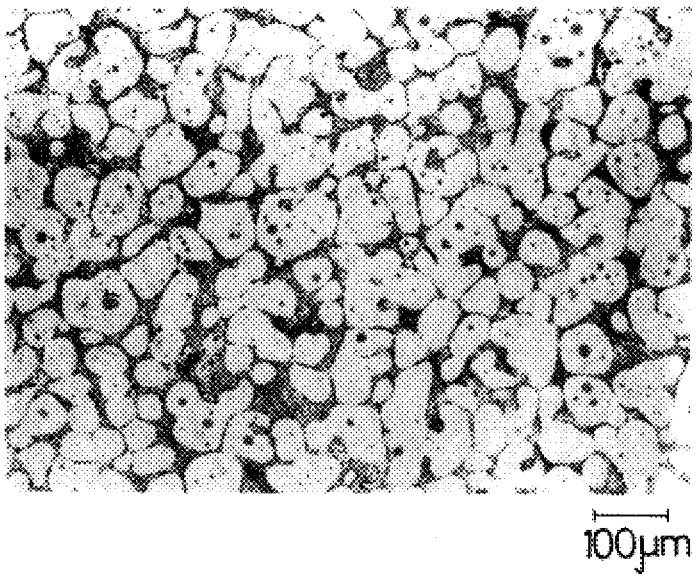
FIG. 12A is a photomicrograph showing the metallographic structure of a main body portion in a fifth example of a semi-molten aluminum alloy material.
Figure 12B:
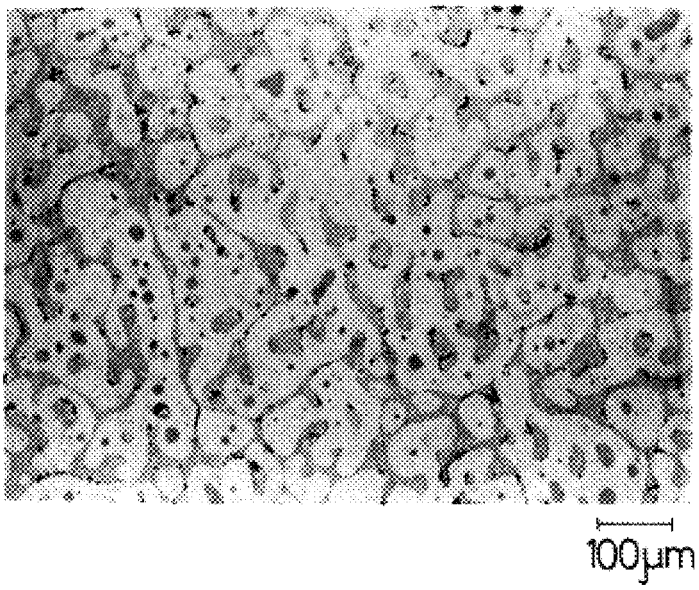
FIG. 12B is a photomicrograph showing the metallographic structure of an outer layer portion in the fifth example of the semi-molten aluminum alloy material.

FIGS. 12A and 12B are photomicrographs showing the metallographic structure of the semi-molten aluminum alloy material VI. FIG. 12A corresponds to the main body portion, and FIG. 12B corresponds to the outer layer portion.

As is apparent from FIG. 12B, the massive solid phase appears due to the aggregation of the spherical solid phases in the outer layer portion. It can be seen from FIG. 12A that the main body portion is of a spherical structure.

If the dendrites in the outer layer portion are transformed into the spherical solid phases as in the aluminum alloy materials I, II, III and IV in Table 4, the charging pressure during the casting can be fixed at a lowered, substantially constant level such as 8 to 9 MPa. Each of the aluminum cast products produced from the aluminum alloy materials I, II, III and IV had a fine metallographic structure, and had no defects such as cutouts and voids generated therein and was sound.

On the other hand, when the dendrites in the outer layer portion is not transformed into the spherical solid phases as in the aluminum alloy materials V and VI in Table 4, the charging pressure rises and as a result, defects are liable to be generated in the aluminum alloy cast product.

Figure 13:
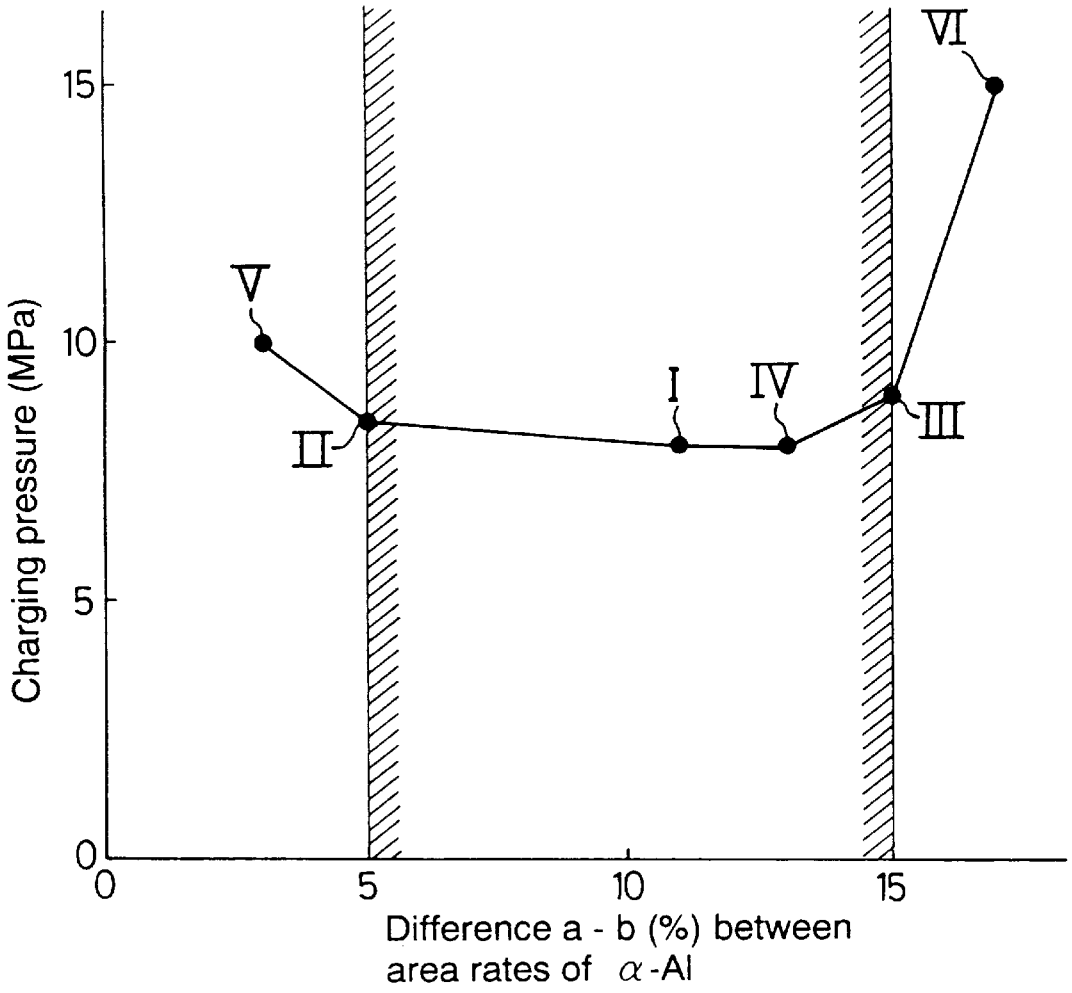
FIG. 13 is a graph illustrating the relationship between the difference a–b between area rates of crystals α-Al and the charging pressure.

FIG. 13 is a graph illustrating the relationship between the difference a−b between the area rates of α-Al and the charging pressure, based on Table 4, wherein points I, II, III, IV, V and VI correspond to the aluminum alloy materials I, II, III, IV, V and VI, respectively.

As is apparent from FIG. 13, it is desirable that the difference a−b between the area rates of α-Al is in a range of $5\% \leqq a-b \leqq 15\%$ in order to reduce the charging pressure.

COMPARATIVE EXAMPLE 1A

The aluminum alloy material in Example 1 was placed into an electric resistance furnace and heated up to 575° C. at which the material was in a semi-molten state having solid and liquid phases coexisting therein and which was a castable temperature, for a long period of time under a condition of a heating time of 3 hours. Thereafter, the metallographic structure in the semi-molten state was fixed by a quenching process and examined to provide the results shown in FIGS. 14A and 14B as Comparative Example 1A.

Figure 14A:
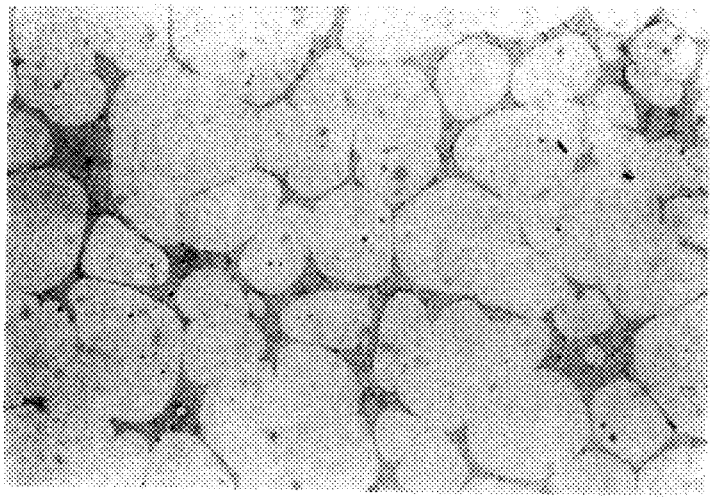
FIG. 14A is a photomicrograph showing the metallographic structure of a main body portion in a sixth example of a semi-molten aluminum alloy material.
Figure 14B:
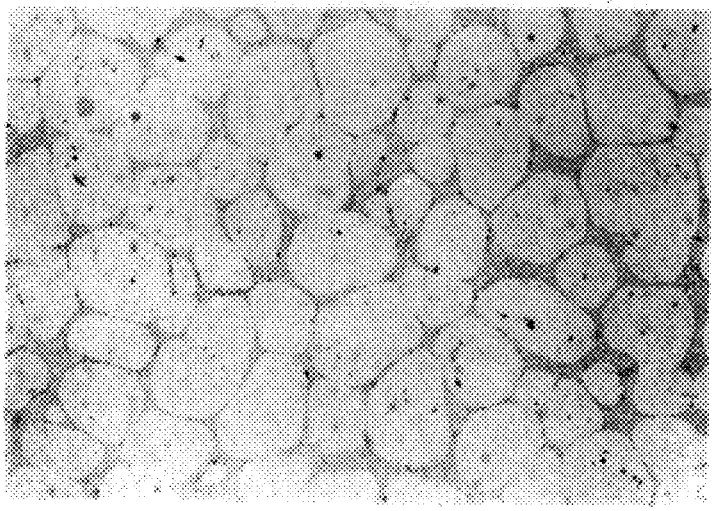
FIG. 14B is a photomicrograph showing the metallographic structure of an outer layer portion in the sixth example of the semi-molten aluminum alloy material.

FIG. 14A is a photomicrograph showing the metallographic structure of the main body portion, and FIG. 14B is a photomicrograph showing the metallographic structure of the outer layer portion.

As is apparent from FIG. 14B, the dendrites in the outer layer potion were transformed into the spherical solid phases by semi-melting. In this case, an average diameter D of the spherical solid phases of α-Al is equal to 160 μm, and the spherical solid phase is relatively fine.

On the other hand, as is apparent from FIG. 14A, the main body portions also has a spherical structure, but in this case, an average diameter D of the spherical solid phases of α-Al is equal to 210 μm. The reason why the metallographic structure of the main body portion was coalesced or bulked in this way is that the aluminum alloy material II was heated for the long period of time.

Then, using the semi-molten alloy material II after being heated and using the pressure casting apparatus 1 shown in FIG. 9, an aluminum alloy cast product IIa was produced by the same casting operation as that in Example 1.

Test pieces were fabricated from the aluminum alloy cast product I made using the aluminum alloy material I in Example 1 and the aluminum alloy cast product II*a* in Comparative Example 1A. Then, each of the test pieces was subjected to a T6 treatment (comprising a heating at 540° C. for 5 hours, a water-cooling and a heating at 170° C. for 5 hours) and then to a tension test to provide results given in Table 5. In Table 5, the test pieces I and II*a* correspond to the aluminum alloy cast products I and II*a*, respectively.

TABLE 5

| Test piece | Tensile strength (MPa) | 0.2% proof strength (MPa) | Breaking elongation (%) |
|---|---|---|---|
| I | 330 | 300 | 8.1 |
| IIa | 280 | 230 | 1.2 |

As is apparent from Table 5, the test piece I in Example 1 has a high strength and a high ductility. This is attributable to the fact that the dendrites in the outer layer portion were transformed into the spherical solid phases, and the spherical structures of the outer layer portion and the main body portion were made fine.

On the other hand, the test piece II*a* in Comparative Example 1A has a low strength and a low ductility, as compared with the test piece I, due to the fact that the spherical structure of the main body portion was coalesced or bulked.

EXAMPLE 2

The aluminum alloy material I in Example 1 was placed into the induction heating furnace and subjected to a primary induction heating step in a coil of the induction heating furnace under conditions of a frequency $f_1$, of 2 kHz (constant) and an energizing time of 3 minutes (output 90%).

Thus, a skin effect similar to that in Example 1 appeared further remarkably and hence, the outer layer portion was increased in temperature preferentially to the main body portion to become a semi-molten state having solid and liquid phases coexisting therein.

Then, the aluminum alloy material I was subjected to a secondary induction heating step in the coil under conditions of a frequency $f_2$ of 1 kHz (constant) and an energizing time of 4 minutes (output 50% for first 1 minute and output 37% for next 3 minutes).

This caused the main body portion to rise in temperature to become a semi-molten state having solid and liquid phases coexisting therein.

In this manner, the aluminum alloy material I was heated up to 575° C. which was a castable temperature. Thereafter, the metallographic structure in the semi-molten state was fixed by a quenching process and examined. As a result, it was made clear that the dendrites in the outer layer portion were transformed into the spherical solid phases. In this case, an average diameter D of the spherical solid phases of α-Al was equal to 160μm.

The main body portion also had a spherical structure. In this case, an average diameter D of the spherical solid phases of α-Al was equal to 120 μm.

Then, using the semi-molten aluminum alloy material I after being heated and using the pressure casting apparatus 1 shown in FIG. 9, an aluminum alloy cast product was produced by the same casting operation as in Example 1. This is called a sample 1.

Likewise, using the aluminum alloy material I, two aluminum alloy cast products were produced under the same conditions as those described above, except that the frequency $f_1$ at the primary induction heating step was changed for this example 2. These are called samples 2 and 3, respectively.

Table 6 shows the relationship between the frequencies $f_1$ and $f_2$ at the primary and secondary induction heating steps and the charging pressure. For comparison, data relating to the aluminum alloy material I in Example 1 are shown in table 6 as those in an sample 4.

TABLE 6

| | Frequency $f_1$, $f_2$ (kHz) | | |
|---|---|---|---|
| | $f_1$ at primary induction heating step | $f_2$ at secondary induction heating step | Charging pressure (MPa) |
| Sample 1 | 2 | 1 | 7.5 |
| Sample 2 | 5 | 1 | 7 |
| Sample 3 | 10 | 1 | 7 |
| Sample 4 | 1 | 1 | 8 |

As is apparent from Table 6, if the frequency $f_1$ at the primary induction heating step is set higher than the frequency $f_2$ at the secondary induction heating step, as in samples 1 to 3, the spherical solid phases resulting from the transformation of the dendrites can be formed into a shape closer to a spherical shape, as compared with that of the sample 4 and therefore, the charging pressure is lower than that in the sample 4.

The frequency $f_1$ at the primary induction heating step is preferably in a range of 0.8 kHz$<f_1\leqq$50 kHz for the preferential rising in temperature of the outer layer portion. If the frequency $f_1$ is lower than 0.8 kHz or higher than 50 kHz, the efficiency of a heating oscillating circuit is poor and hence, such frequency levels are not practical.

The frequency $f_2$ at the secondary induction heating step is preferably in a range of 0.8 kHz$\leqq f_2\leqq$5 kHz for the uniform heating of the main body portion. If the frequency $f_2$ is lower than 0.8 kHz, it is likewise not practical. On the other hand, if $f_2$>5 kHz, the outer layer portion is preferentially heated and hence, the entire main body portion cannot be uniformly heated. The reason why the frequency $f_1$ is defined higher than 0.8 kHz is that the relation, $f_1>f_2$ is satisfied.

On the other hand, if the frequency $f_1$ at the primary induction heating step is set lower than the frequency $f_2$ at the secondary induction heating step, namely, $f_1<f_2$, the following disadvantages are encountered: the oxidation of the outer layer portion is promoted to form a thick oxide film, and a part of the outer layer portion flows out, resulting in a reduced yield.

(B) Average Diameter of Spherical Solid Phases in Outer Layer Portion in Semi-Molten State

EXAMPLE 1B

An aluminum alloy material I was prepared which had the hypoeutectic aluminum alloy composition shown in Table 3, which was made in an agitated casting process and which had a diameter of 76 mm and a length of 100 mm.

Figure 15A:
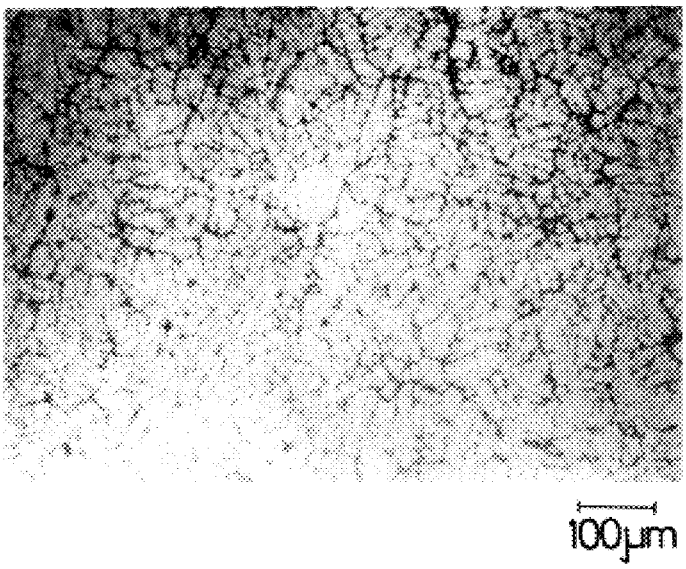
FIG. 15A is a photomicrograph showing the metallographic structure of an outer layer portion in a seventh example of an aluminum alloy material.
Figure 15B:
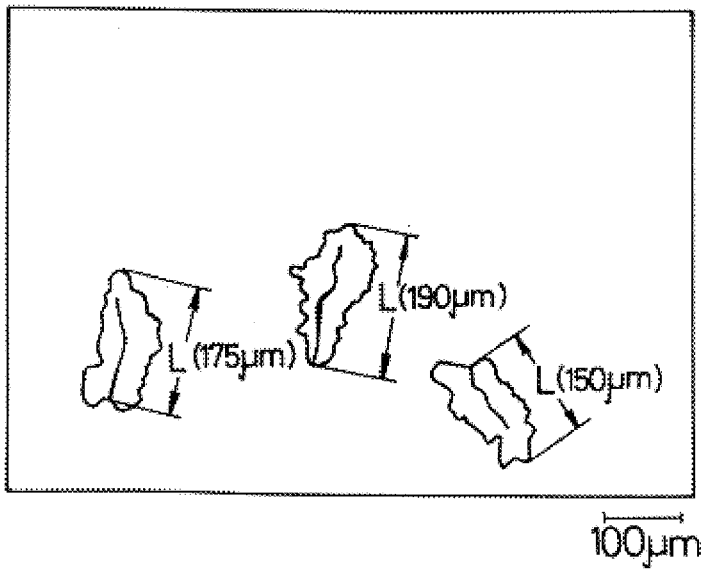
FIG. 15B is a tracing of an essential portion shown in FIG. 15A.

FIG. 15A is a photomicrograph showing the metallographic structure of an outer layer portion of the aluminum alloy material I, and FIG. 15B is a tracing of an essential portion shown in FIG. 15A. In this case, an average trunk length L of the dendrite is equal to 172 μm. The area rate a of α-Al in the outer layer portion is equal to 81%, and the area rate b of α-Al in the main body portion is equal to 76%.

The aluminum alloy material I was placed into the induction heating furnace and then subjected to an induction heating under conditions of a frequency f of 1 kHz (constant) and an energizing time of 7 minutes (output 90% for first 3 minutes, output 50% for next 1 minute and output 37% for last 3 minutes).

In this case, the electric resistance value of the outer layer portion is lower than that of the main body portion due to the fact that the area rate a of α-Al in the outer layer portion is higher than the area rate b of α-Al in the main body portion and the α-Al has a good conductivity. Therefore, a skin effect remarkably appeared in the outer layer portion, thereby causing the outer layer portion to rise in temperature preferentially to the main body portion to become a semi-molten state having solid and liquid phases coexisting therein. A subsequent induction heating caused the main body portion to rise in temperature to likewise become a semi-molten state having solid and liquid phases coexisting therein.

In this manner, the aluminum alloy material was heated up to 575° C. which was a castable temperature. Then, the metallographic structure in the semi-molten state was fixed by a quenching process, and the metallographic structure of the outer layer portion was examined to provide a result shown in FIG. 16.

Figure 16:
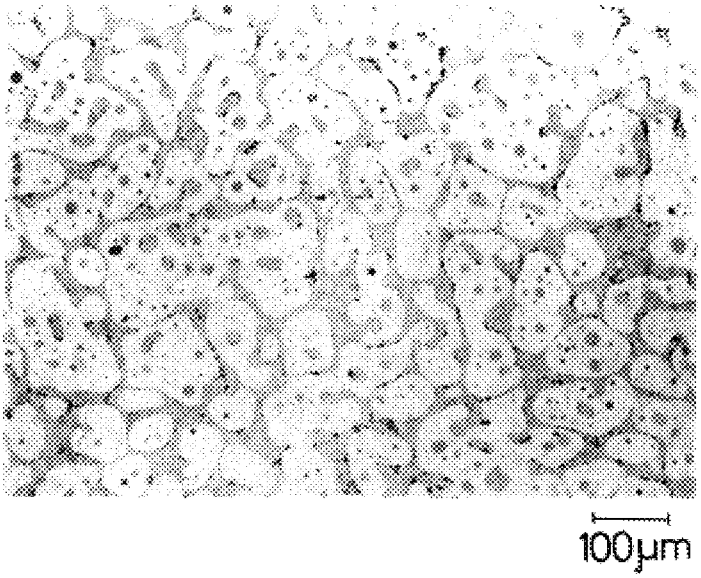
FIG. 16 is a photomicrograph showing the metallographic structure of an outer layer portion in a seventh example of an semi-molten aluminum alloy material.

FIG. 16 is a photomicrograph showing the metallographic structure of the outer layer portion. It can be seen from FIG. 16 that the dendrites in the outer layer portion were transformed into spherical solid phases by the semi-melting. In this case, an average diameter D of the solid phases of α-Al is equal to 200 μm.

The main body portion also has a fine spherical structure for the same reason as that described above.

Then, the die temperature in the pressure casting apparatus 1 shown in FIG. 9 was set at 250° C., the semi-molten alloy material I (designated by reference character 5) after being heated was placed into the chamber 6 in the pressure casting apparatus 1. The pressing plunger 9 was operated to charge the semi-molten aluminum alloy material I into the cavity 4. In this case, the pressure for charging the semi-molten aluminum alloy material I was of 8 MPa. Then, a pressing force was applied to the semi-molten aluminum alloy material I filled in the cavity 4 by retaining the pressing plunger 9 at a stroke end, thereby solidifying the aluminum alloy material I under such pressure to provide an aluminum alloy cast product I.

Figure 17:
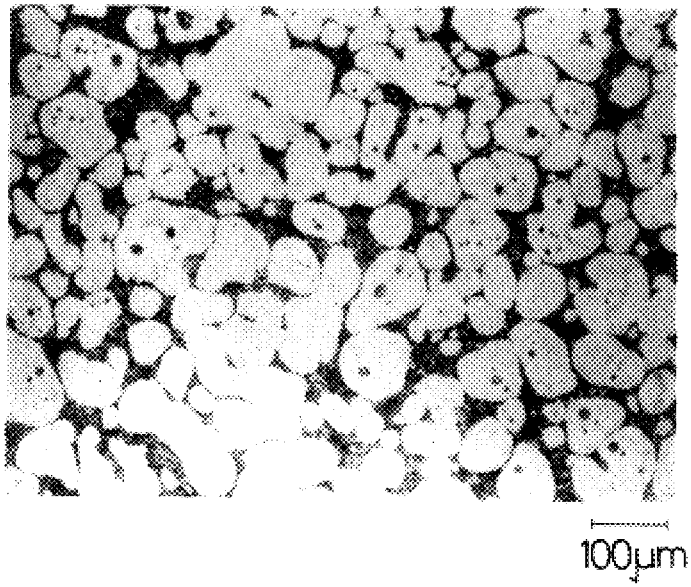
FIG. 17 is a photomicrograph showing the metallographic structure of an aluminum alloy cast product made using the seventh example of the aluminum alloy material.

FIG. 17 is a photomicrograph showing the metallographic structure of the aluminum alloy cast product I. It can be seen from FIG. 17 that the metallographic structure is homogeneous.

This is attributable to the fact that the casting material was solidly passed through the gate without separation of the solid and liquid phases from each other when it is charged into the cavity.

EXAMPLE 2B

An aluminum alloy material II was prepared which had the hypoeutctic aluminum alloy composition shown in Table 3, which was made in an agitated casting process and which had a diameter of 76 mm and a length of 100 mm.

Figure 18A:
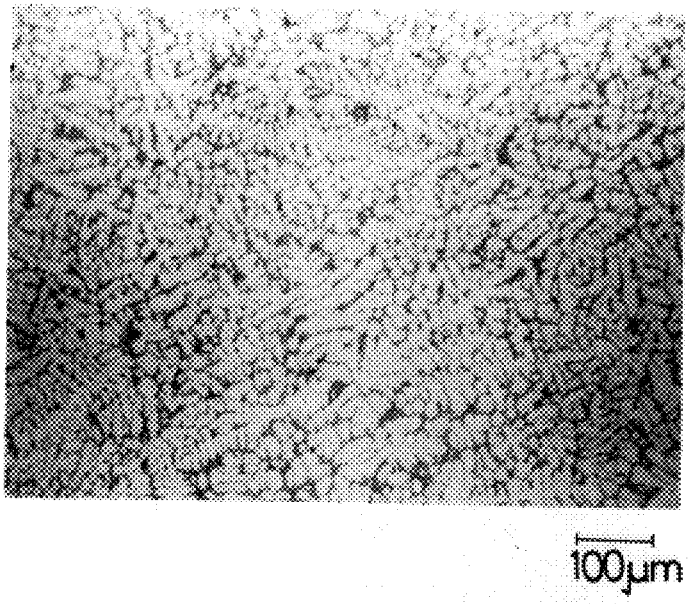
FIG. 18A is a photomicrograph showing the metallographic structure of an outer layer portion in an eighth example of an aluminum alloy material.
Figure 18B:
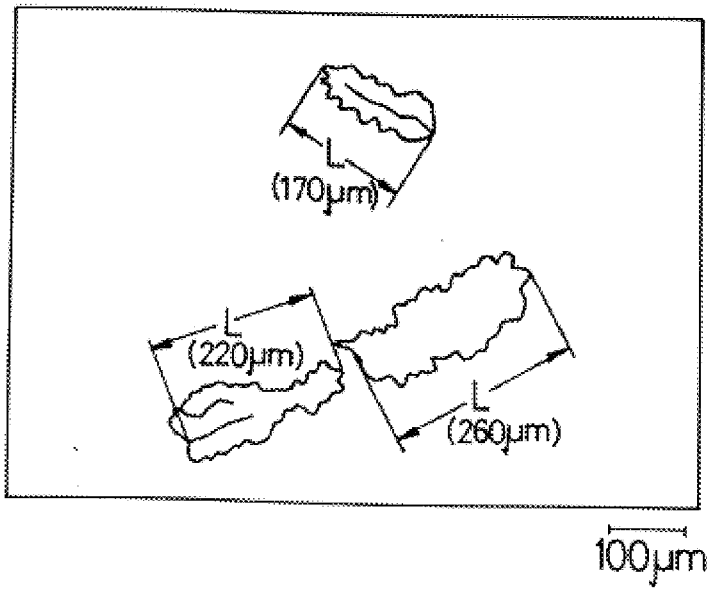
FIG. 18B is a tracing of an essential portion shown in FIG. 18A.

FIG. 18A is a photomicrograph showing the metallographic structure of an outer layer portion of the aluminum alloy material II, and FIG. 18B is a tracing of an essential portion shown in FIG. 18A. In this case, an average trunk length L of the dendrite is equal to 216 μm. The area rate a of α-Al in the outer layer portion is equal to 82%, and the area rate b of α-Al in the main body portion is equal to 75%.

The aluminum alloy material II was placed into the induction heating furnace and then subjected to an induction heating under the same conditions as in Example 1B. Then, the aluminum alloy material II was heated up to 575° C. at which the material II was in a semi-molten state having solid and liquid phases coexisting therein and which was a castable temperature. Thereafter, the metallographic structure in the semi-molten state was fixed by a quenching process, and the metallographic structure of the outer layer portion was examined to provide a result shown in FIG. 19.

Figure 19:
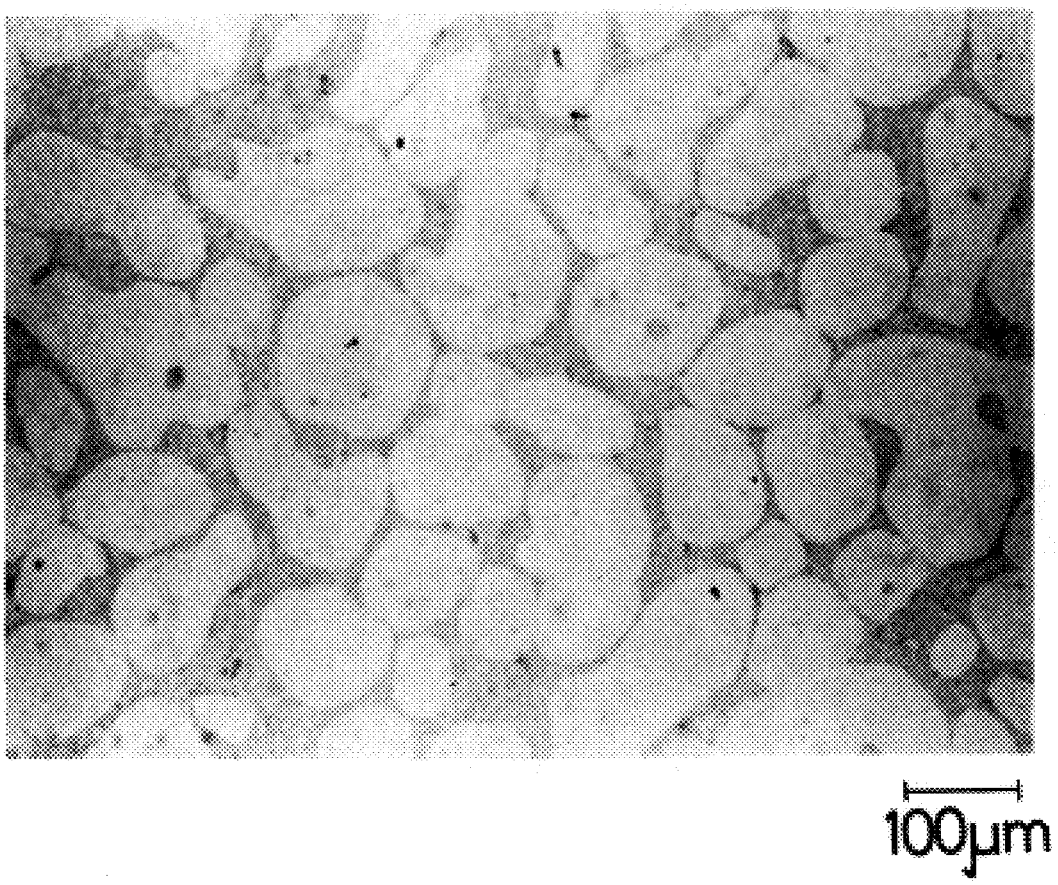
FIG. 19 is a photomicrograph showing the metallographic structure of an outer layer portion in the eighth example of a semi-molten aluminum alloy material.

FIG. 19 is a photomicrograph showing the metallographic structure of the outer layer portion. It can be seen from FIG. 19 that the dendrites in the outer layer portion were transformed into spherical solid phases by the semi-melting. In this case, an average diameter D of the solid phases of α-Al is equal to 230 μm.

Then, using the semi-molten aluminum alloy material II after being heated and using the pressure casting apparatus 1 shown in FIG. 9, an aluminum alloy cast product II was produced by the same casting operation as in Example 1B. In this case, the pressure for charging the semi-molten aluminum alloy material II was of 14 MPa.

Figure 20A:
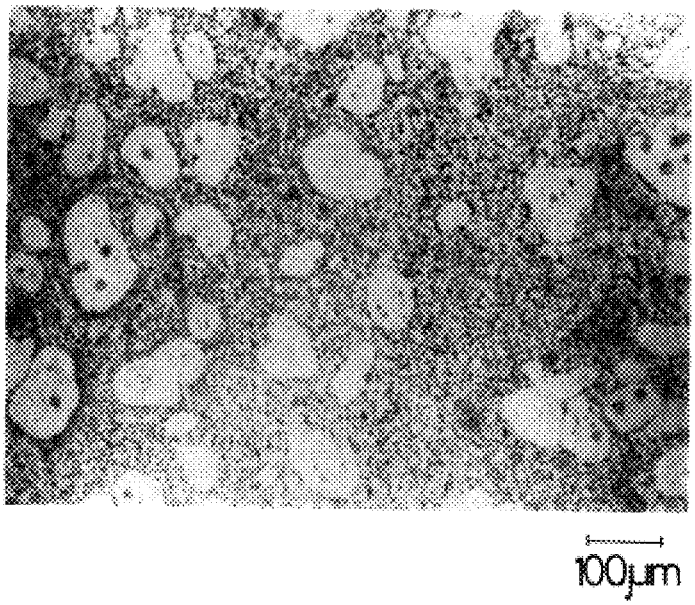
FIG. 20A is a photomicrograph showing one example of the metallographic structure of an aluminum alloy cast product made using the eighth example of the aluminum alloy material.
Figure 20B:
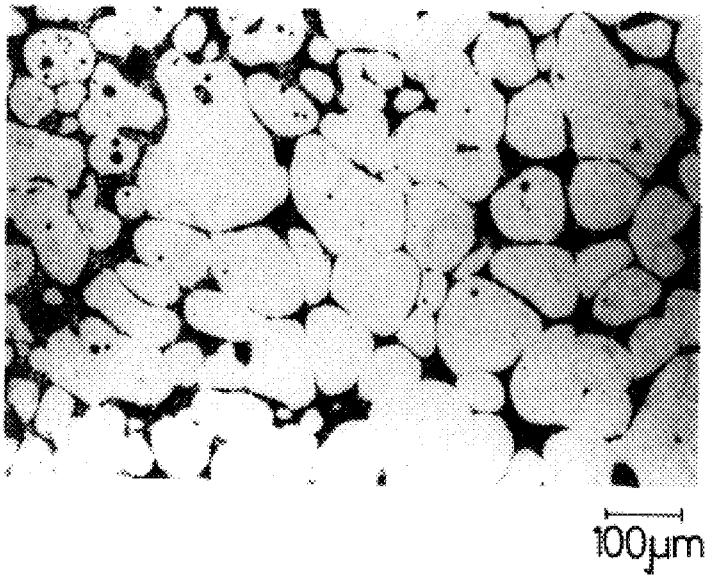
FIG. 20B is a photomicrograph showing another example the metallographic structure of an aluminum alloy cast product made using the eighth example of the aluminum alloy material.

FIGS. 20A and 20B are photomicrographs showing the metallographic structures of different portions of the aluminum alloy cast product II, respectively. As is apparent from the comparison of FIGS. 20A and 20B, the metallographic structures are non-homogeneous.

This is because when the semi-molten aluminum alloy material II was charged into the cavity, the clogging of the gate (having a diameter of 10 mm) with the material II occurred to result in a separation of the solid and liquid phases from each other, because the average diameter D of the solid phases in the outer layer portion was as large as 230 μm.

From the comparison of FIG. 17 with FIGS. 20A and 20B, it is desirable for the average diameter D of the spherical solid phases in the outer layer portion of the semi-molten aluminum alloy material in a solid/liquid phase coexisting state to be in a range of $D \leqq 200$ μm.

Then, test pieces were fabricated from the aluminum alloy cast products I and II in Examples 1B and 2B and subjected to a T6 treatment similar to that described above and then to a tension test to provide results given in Table 7. In Table 7, test pieces I and II correspond to the aluminum alloy cast products I and II, respectively.

TABLE 7

| Test piece | Tensile strength (MPa) | Breaking elongation (%) |
|---|---|---|
| I | 332 | 8.0 |
| II | 320 | 5.0 |

As apparent from Table 7, it can be seen that the test piece I in Example 1B has a higher strength and a larger ductility than those of the test piece II in Example 2B. This is attribute to the difference of the metallographic structures of the aluminum alloy cast products I and II and, originally, the difference between the average diameters D of the solid phases in the outer layer portions of the semi-molten casting materials.

What is claimed is:

1. A process for producing a thixocast semi-molten casting material comprising the steps of preparing a thixocast material including an outer layer portion having dendrites around an outer periphery of a main body portion, subjecting the thixocast material to a heating treatment to thereby produce a semi-molten casting material having solid and liquid phases coexisting therein, said heating treatment comprising primary and secondary induction heating steps, conducting said primary induction heating step at a frequency $f_1$ for transforming said dendrites into spherical solid phases by preferentially increasing a temperature of said outer layer portion relative to a temperature of said main body portion thereby to bring said outer layer portion into a semi-molten state, and conducting said secondary heating step at a frequency $f_2$ lower than said frequency $f_1$ of the primary induction heating step to raise the temperature of said main body portion and bring said main body portion into a semi-molten state during said secondary induction heating step.

2. A process for producing a thixocast semi-molten casting material according to claim 1, wherein an average diameter D of said spherical solid phases in the outer layer portion in said semi-molten state is in a range of $D \leqq 200\ \mu m$.

3. A process for producing a thixocast semi-molten casting material according to claim 1 or 2, wherein said casting material comprises an aluminum alloy, and wherein the frequency $f_1$ of said primary induction heating step is set in a range of $0.8\ kHz < f_1 \leqq 50\ kHz$, and the frequency $f_2$ of said secondary induction heating step is set in a range of $0.8\ kHz \leqq f_2 \leqq 5\ kHz$.

4. A process for producing a thixocast semi-molten casting material according to claim 3, wherein an area rate of α-Al crystals in said outer layer portion is represented by a%, an area rate of α-Al crystals in said main body portion is represented by b%, and a difference a%–b% between the area rates is in a range of $5\% \leqq a\% - b\% \leqq 15\%$.

5. A process for producing a thixocast semi-molten casting material of an aluminum alloy, comprising:

preparing a thixocast material including an outer layer portion having dendrites around an outer periphery of a main body portion with an area rate of α-Al crystals in said outer layer portion being a%, an area rate of α-Al crystals in said main body portion being b%, and a difference a%–b% between said area rates being in a range of $5\% \leqq a\% - b\% \leqq 15\%$; and subjecting said thixocast material to a heating treatment to produce a semi-molten casting material having solid and liquid phases coexisting therein and transforming said dendrites into spherical solid phases by preferentially increasing a temperature of said outer layer portion relative to a temperature of said main body portion and thereby to bring said outer layer portion into a semi-molten state.

6. A process for producing a thixocast semi-molten casting materials according to claim 5, wherein the preferential increasing of the temperature of said outer layer portion is achieved by an induction hearing.

7. A process for producing a thixocast semi-molten casting material according to claim 5 or 6, wherein an average diameter D of said spherical solid phases in said outer layer portion in the semi-molten state is in a range of $D \leqq 200\ \mu m$.

* * * * *